US006312861B1

(12) United States Patent
Ciccarelli et al.

(10) Patent No.: US 6,312,861 B1
(45) **Date of Patent: *Nov. 6, 2001**

(54) TONER COMPOSITIONS

(75) Inventors: Roger N. Ciccarelli, Rochester; Denise R. Bayley, Fairport, both of NY (US); James R. Combes, Burlington (CA); Thomas R. Pickering, Webster, NY (US); Jacques C. Bertrand, Amherst, NH (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,586

(22) Filed: Oct. 26, 2000

Related U.S. Application Data

(62) Division of application No. 09/132,623, filed on Aug. 11, 1998, now Pat. No. 6,190,815.

(51) Int. Cl.[7] ..... G03G 9/08

(52) U.S. Cl. ..... 430/108.3; 430/108.7; 430/137.11

(58) Field of Search ..... 430/110, 137, 430/109.4, 108.7, 108.3, 137.11

(56) References Cited

U.S. PATENT DOCUMENTS

| | | | | |
|---|---|---|---|---|
| 5,914,210 | * | 6/1999 | Demizu et al. | 430/110 |
| 6,087,059 | * | 7/2000 | Duggan et al. | 430/109.4 |
| 6,203,960 | * | 3/2001 | Ciccarelli et al. | 430/110 |
| 6,214,507 | * | 4/2001 | Sokol et al. | 430/110 |

OTHER PUBLICATIONS

Diamond, Arthur S. (editor) Handbook of Imaging Materials. New York: Marcel–Dekker, Inc. pp. 162–170, 1991.*

Grant, Roger et al. Grant and Hackh's Chemical Dictionary. New York: McGraw–Hill, Inc. p. 373. 1987.*

Alger, Mark S. Polymer Science Dictionary. London: Elsevier Applied Science. pp. 39–40. (1989).*

* cited by examiner

*Primary Examiner*—Christopher Rodee
(74) *Attorney, Agent, or Firm*—Oliff & Berridge, PLC; Eugene Palazzo

(57) ABSTRACT

A toner comprised of resin, colorant and a coated silica, and wherein said silica has a primary particle size of about 25 nanometers to about 55 nanometers, and an aggregate size of about 225 nanometers to about 400 nanometers, and said coating is comprised of a mixture of an alkylsilane and an aminoalkylsilane.

30 Claims, No Drawings

TONER COMPOSITIONS

COPENDING APPLICATIONS

This application is a divisional of Application(s) Ser. No(s). 09/132,623, filed Aug. 11, 1998, now U.S. Pat. No. 6,190,815.

Illustrated in copending applications U.S. Ser. No. 09/132,188, now U.S. Pat. No. 6,004,714, filed concurrently herewith, the disclosure of which is totally incorporated herein by reference, is a toner comprised of resin, colorant and a coated silica, and a coating comprised of an alkylsilane; and U.S. Ser. No. 09/132,185, now U.S. Pat. No. 6,214,507, filed concurrently herewith, the disclosure of which is totally incorporated herein by reference, is a toner with a coated silica with, for example, certain BET characteristics.

The appropriate components and processes of the copending applications, such as the alkylsilane coating, may be selected for the present invention in embodiments thereof.

BACKGROUND OF THE INVENTION

The present invention is generally directed to toner and developer compositions, and more specifically, the present invention is directed to positively, or negatively charged toner compositions, or toner particles containing coated silica surface additives. The coated silicas are available from Cabosil, and more specifically these silicas preferably possess a primary particle size of about 25 nanometers to about 55 nanometers and an aggregate size of about 225 nanometers to about 400 nanometers. With the toners of the present invention, in embodiments thereof a number of advantages are achievable, such as excellent stable triboelectric charging characteristics, substantial insensitivity to humidity, especially humidities of from about 20 to about 80 weight percent, superior toner flow through, acceptable triboelectric charging values, such as from about 15 to about 55 microcoulombs per gram as determined, for example, by the known Faraday Cage, and wherein the toners enable the generation of developed images with superior resolution, and excellent color intensity. The aforementioned toner compositions can contain colorants, such as dyes or pigments comprised of, for example, carbon black, magnetites, or mixtures thereof, cyan, magenta, yellow, blue, green, red, or brown components, or mixtures thereof, thereby providing for the development and generation of black and/or colored images, and in embodiments the toner can be selected for two component development and single component development wherein a carrier or carrier particles are avoided.

The toner and developer compositions of the present invention can be selected for electrophotographic, especially xerographic, imaging and printing processes, including color, digital processes, and multisystems is apparatus and machines.

PRIOR ART

Toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are each generally present in an amount of from about 1 weight percent by weight to about 5 weight percent by weight, and preferably in an amount of from about 1 weight percent by weight to about 3 weight percent by weight. Several of the aforementioned additives are illustrated in U.S. Pat. Nos. 3,590,000 and 3,900,588, the disclosures of which are totally incorporated herein by reference. Also known are toners containing a mixture of hexamethyldisilazane (HMDZ) and APTES, an aminopropyltriethoxysilane.

Further, toner compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. These and other charge enhancing additives, such as these illustrated in U.S. Pat. Nos. 5,304,449, 4,904,762, and 5,223,368, the disclosures of which are totally incorporated herein by reference, may be selected for the present invention in embodiments thereof.

SUMMARY OF THE INVENTION

Examples of features of the present invention in embodiments thereof include:

It is a feature of the present invention to provide toner and developer compositions with a mixture of certain surface additives, and wherein the toners possess a number of advantages.

In another feature of the present invention there are provided negatively charged toner compositions useful for the development of electrostatic latent images including color images.

In yet another feature of the present invention there are provided negatively charged toner compositions useful for the development of electrostatic latent images including full process color images.

In another feature of the present invention there are provided toner surface additives that enable fast toner admix as measured by a charge spectrograph.

Also, in another feature of the present invention there are provided coated silica surface additives that enable toner unimodal charge distribution as measured by a charge spectrograph.

Further, in another feature of the present invention there are provided certain surface additives that enable an unimodal charge distribution upon admix of fresh toner into aged toner as measured by a charge spectrograph.

Other features of the present invention include providing toner and developer compositions with a mixture of certain surface additives that enable acceptable high stable triboelectric charging characteristics from for example about 15 to about 60 microcoulombs per gram, and preferably from about 25 to about 40 microcoulombs per gram; toner and developer compositions with coated silica additives that enable humidity insensitivity, from about, for example, 20 to 80 weight percent relative humidity at temperatures of from about 60 to about 80° F. as determined in a relative humidity testing chamber; toner and developer compositions with a mixture of certain surface additives that enable negatively charged toner compositions with desirable admix properties of 1 second to about 60 seconds as determined by the charge spectrograph, and more preferably less than about 30 seconds; toner compositions with a mixture of certain surface additives that enable for example, low temperature fusing resulting in high quality black and or color images; and the formation of toners with a mixture of coated silica surface additives which will enable the development of images in electrophotographic imaging apparatuses, which images have substantially no background deposits thereon, are substantially smudge proof or smudge resistant, and therefore are of excellent resolution, and further, such toner compositions can be selected for high speed electrophotographic apparatuses, that is those exceeding about 60 copies per minute, and more specifically from about 60 to about 100 copies per minute.

In another feature of the present invention there are provided positively charged toner compositions useful for the development of electrostatic latent images including color images.

In yet a further feature of the present invention there are provided humidity insensitive, from about, for example, 20 to 80 weight percent relative humidity at temperatures of from 60 to 80° F. as determined in a relative humidity testing chamber, positively charged toner compositions with desirable admix properties of about 5 seconds to about 60 seconds as determined by the charge spectrograph, and preferably less than about 15 seconds for example, and more preferably from about 1 to about 14 seconds, and acceptable high stable triboelectric charging characteristics of from about 20 to about 50 microcoulombs per gram.

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Aspects of the present invention are a toner comprised of resin, colorant and a coated silica, and wherein said silica has a primary particle size of about 25 nanometers to about 55 nanometers and an aggregate size of about 225 nanometers to about 400 nanometers, and said coating is comprised of a mixture of an alkylsilane and an aminoalkylsilane; a toner wherein said coating is generated from a mixture of about 10 weight percent to 25 weight percent of an alkylalkoxysilane and about 0.10 weight percent to about 5.0 weight percent of an aminoalkylalkoxysilane; a toner wherein the toner further contains surface additives of metal oxides, metal salts, metal salts of fatty acids, or mixtures thereof; a toner wherein the toner further contains surface additives of titania, metal salts of fatty acids, or mixtures thereof; a toner wherein the resin is polyester; a toner wherein the resin is a polyester formed by condensation of propoxylated bisphenol A and a dicarboxylic acid; a toner wherein the resin is comprised of a mixture of a polyester formed by condensation of propoxylated bisphenol A and fumaric acid, and a gelled polyester formed by condensation of propoxylated bisphenol A and fumaric acid; a toner wherein the colorant is carbon black, cyan, magenta, yellow, red, orange, green, violet, or mixtures thereof; a toner wherein the silica is coated with a mixture of a decylsilane and aminopropylsilane; a toner wherein alkyl contains from about 1 to, about 25 carbon atoms; a toner wherein said alkyl is butyl, hexyl, octyl, decyl, dodecyl, or stearyl; a toner wherein the silica is coated with a polymer mixture of (1) an alkylsilane, and (2) said aminoalkylsilane; a toner wherein the titania or titanium dioxide is coated with an alkylsilane; a toner wherein said titania is coated with decylsilane; a toner wherein the silica is coated with an input feed mixture of about 10 weight percent to about 25 weight percent alkyltrialkoxysilane and about 0.10 weight percent to about 5.0 weight percent aminoalkyltrialkoxysilane; a toner wherein alkyl contains from 1 to about 25 carbon atoms; a toner wherein the alkyltrialkoxysilane and the aminoalkyltrialkoxysilane are coated either in combination or sequentially; a toner wherein the silica is coated with an input feed mixture of about 5 to about 15 weight percent decyltrialkoxysilane and about 0.15 weight percent to about 0.50 weight percent aminoalkyltrialkoxysilane; a toner wherein the silica has a primary particle size of about 25 nanometers to about 55 nanometers, and the coating is present on a core of silicon dioxide; a toner wherein the colorant is a pigment, or a dye, and said alkylsilane is an alkylalkoxysilane; a toner wherein the silica has a primary particle size of about 30 nanometers to about 40 nanometers; a toner wherein the silica has an aggregate size of about 225 nanometers to about 400 nanometers; or has an aggregate size of about 300 nanometers to about 375 nanometers, or has a primary particle size of about 25 nanometers to about 55 nanometers, or has a primary particle size of about 30 nanometers to about 40 nanometers with an aggregate size of about 150 nanometers to about 400 nanometers or an aggregate size of about 200 nanometers to about 275 nanometers; a toner wherein the coated silica is present in an amount of from about 1 weight percent to about 10 weight percent; a toner wherein the coated silica is present in an amount of from about 4 weight percent to about 10 weight percent; a toner wherein the titania is present in an amount from about 1 weight percent to about 5 weight percent, or wherein the titania is present in an amount from about 1.5 weight percent to about 3.5 weight percent; a toner wherein the metal salt is zinc stearate and is present in an amount from about 0.10 weight percent to about 0.60 weight percent; a toner with a triboelectric charge of from about 15 to about 55, or with a triboelectric charge of from about 25 to about 40; a toner wherein the resin is present in an amount of from about 85 weight percent to about 99 weight percent and the colorant is present in an amount from about 15 weight percent to about 1 weight percent; a developer comprised of toner and carrier; a developer with a unimodal charge distribution as measured by a charge spectrograph; a toner further containing a charge additive, a wax, or mixtures thereof; a process for the preparation of a toner comprising admixing resin, colorant, and a coated silica, wherein the silica has a primary particle size of about 25 nanometers to about 55 nanometers and an aggregate size of about 225 nanometers to about 400 nanometers, and the coating is comprised of a mixture of an alkylsilane and an aminoalkylsilane; a process wherein the coating mixture is generated from an alkyloxysilane and an aminoalkylalkoxysilane; a toner wherein the silica coating is a polymer, and said coating is contained on a silicon dioxide core; a toner wherein the silica coating is represented by the formula

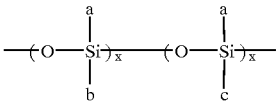

wherein a represents a repeating segment of the formula

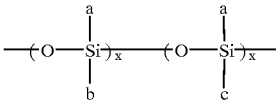

and thereby optionally enables, for example, a crosslinked formula or structure; the repeating segment above, and hydroxy or hydroxy groups; the repeating segment above, and alkoxy or alkoxy groups; or the repeating segment above, and hydroxy and alkoxy groups; b is alkyl with, for example from 1 to about 25, and more specifically, from about 5 to about 18 carbon atoms, and x represents the number of segments and is, for example, a number of from 1 to about 1,000 and more specifically, from about 25 to about 500, and wherein c is an aminoalkyl, wherein alkyl contains for example from about 1 to about 25 carbon atoms, and wherein c is more specifically an aminopropyl; a toner wherein said coating is comprised of a polymer mixture of decylsilane and aminopropylsilane; and toners comprised of a binder, such as resin particles, colorant, and surface additives comprised of a mixture of certain silicas, metal oxides, such as titanias, especially titanium dioxides, and certain conductivity aides such as metal salts of fatty acids, such as zinc stearate; and toner compositions comprised of binder, colorant, optional additives such as charge additives, optional surface additives such as certain titanias and conductivity aides such as zinc stearate, and a surface additive comprised of silica coated with a mixture of an alkylsilane, such as decylsilane and aminopropylsilane, each present in the mixture as a coating on the silica in various suitable amounts. Based on the weight of silica, the feed input for the alkylsilane such as decylsilane is, for example, from about 5 weight percent to 25, and preferably, for example. from about 10 to about 20 weight percent, and the feed input for the aminoalkylsilane, such as aminopropylsilane is for example from about 0.05 weight percent to 5.0, or from about 0.05 to about 3 weight percent. For example, 100 grams of silica can be mixed with 15 grams of decyltrimethoxysilane and 0.50 grams of aminopropyltriethoxysilane, either together or sequentially. The resulting silica can then be reacted with the decyltrimethoxysilane and aminopropyltriethoxysilane to form a coating on the silica surface. These coated silica particles can be blended on the toner surface in an amount of for example, from about 0.50 weight percent to 10 weight percent, and preferably from about 2.0 weight percent to about 5.0 weight percent. The toner may also include optional additional known surface additives such as certain uncoated or coated metal oxides, such as titania particles present for example in various suitable amounts, like from about 0.50 weight percent to about 10 weight percent, and preferably from about 1.5 weight percent to about 4 weight percent of titania which has been coated with a feed input of from about 5 weight percent to about 15 weight percent decyltriethoxysilane or decyltrialkoxysilane. In addition, the toner may also include further optional surface additives such as a conductivity aides such as metal salts of fatty acids, like zinc stearate in an amount of, for example, from about 0.05 weight percent to about 0.60 weight percent. The coated silica and optional titania surface additives each preferably possess a primary particle size of from about 20 nanometers to about 400 nanometers and preferably from about 25 nanometers to about 55 nanometers.

The coating can be generated from an alkylalkoxy silane and an aminoalkyloxy silane as illustrated herein, and more specifically, from a reaction mixture of a silica like silicon dioxide core and an alkylalkoxy silane, such as decyltrimethoxy silane, and an aminoalkyloxy silane, such as aminopropylalkoxy silane. There results from the reaction mixture the coating contained on the silica core, and optionally containing residual alkoxy groups, and/or hydroxy groups. Preferably, in embodiments the coating is a mixture of the alkylsilane and aminoalkyl silane polymeric coating that contains crosslinking and which coating may, it is believed, be represented by the formula

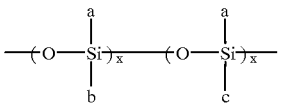

wherein a represents a repeating segment shown above, and more specifically, a is, for example,

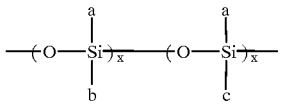

thereby optionally enabling, for example, a crosslinked formula or structure; a repeating segment above, and hydroxy or hydroxy groups; a repeating segment, and alkoxy or alkoxy groups; or a repeating segment, and hydroxy and alkoxy groups; b is alkyl with, for example from 1 to about 25, and more specifically, from about 5 to about 18 carbon atoms; and x represents the number of segments and is, for example, a number of from 1 to about 1,000 and more specifically from about 25 to about 500, and wherein c is preferably an aminoalkyl, wherein alkyl contains, for example, from about 1 to about 25 carbon atoms, and wherein c is, more specifically, an aminopropyl, and b is decyl. The titanium dioxide surface additive can be of a similar formula or structure illustrated with regard to the alkylsilane except that the Si is replaced with Ti.

The toner compositions of the present invention can be prepared by admixing and heating resin particles such as styrene polymers, polyesters, and similar thermoplastic resins, colorant wax, especially low molecular weight waxes, and charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the coated silica and other additives are added by the blending thereof with the toner obtained.

Illustrative examples of suitable toner binders, include toner resins, especially polyesters, thermoplastic resins, polyolefins, styrene acrylates, such as PSB-2700 obtained from Hercules-Sanyo Inc., and preferably selected in the amount of about 57 weight percent, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded resin, especially reactive extruded polyesters with crosslinking as illustrated in U.S. Pat. No. 5,352,556, the disclosure of which is totally incorporated herein by reference, styrene acrylates, and mixtures thereof. Also, waxes with a molecular weight $M_W$ weight average molecular weight of from about 1,000 to about 20,000, such as polyethylene, polypropylene, and paraffin waxes, can be included in, or on the toner compositions as fuser roll release agents. The resin is present in a sufficient, but effective amount, for example from about 50 to about 90 weight percent.

Colorant includes pigment, dyes, mixtures thereof, mixtures of dyes, mixtures of pigments and the like present in suitable amounts such as from about 1 to about 20 and preferably from about 2 to about 10 weight percent. Colorant examples are carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL, and known suitable dyes, such as red, blue, green, and the like.

Magnetites include a mixture of iron oxides ($FeO.Fe_2O_3$), including those commercially available as MAPICO BLACK™, and are present in the toner composition in various effective amounts, such as an amount of from about 10 weight percent by weight to about 75 weight percent by weight, and preferably in an amount of from about 30 weight percent by weight to about 55 weight percent by weight.

There can be included in the toner compositions of the present invention charge additives as indicated herein in various effective amounts, such as from about 1 to about 19, and preferably from about 1 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 1 weight percent by weight to about 15 weight percent by weight, and preferably in an amount of from about 2 weight percent by weight to about 10 weight percent by weight. The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

Developers include the toners illustrated herein with the mixture of silicas on the surface and carrier particles. Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 weight percent toner concentration to about 8 weight percent toner concentration. The carriers can include coatings thereon, such as those illustrated in the U.S. Pat. Nos. 4,937,166 and 4,935,326, and other known coatings. There can be selected a single coating polymer, or a mixture of polymers. Additionally, the polymer coating, or coatings may contain conductive components therein, such as carbon black in an amount, for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present invention, reference for example a number of the patents mentioned herein, and U.S. Pat. Nos. 4,585,884; 4,584,253; 4,563,408 and 4,265,990, the disclosures of which are totally incorporated herein by reference.

The following Examples are being submitted to further define various pieces of the present invention. These Examples are intended to be illustrative only and are not intended to limit the scope of the present invention. Comparative Examples and data are also submitted.

EXAMPLE I

Preparation of Coated Silica

200 Milliliters of dry n-propanol solvent were placed in a three neck 500 milliliters round bottom flask, and the solvent was sparged with dry nitrogen to remove excess oxygen. One 10 milliliter aliquot of solvent was removed to a small 2 dram vial and set aside. A second 20 milliliter aliquot was also removed and placed in a scintillation vial. 15 Grams of untreated hydrophilic $SiO_2$ silica TL90 available from Cab-O-Sil Corp. with a primary particle size of 30 nanometers as measured by BET, named for Brunauer, Emmett, and Teller, and which BET is a standard known technical method that measures surface area, and with model assumptions there can be calculated, for example, the primary particle size, and an aggregate size of about 300 nanometers as measured by Browning Motion was added to the flask and mixed with a mechanical mixer until wetted. An inert atmosphere was maintained during this mixing. A few drops of diethylamine was added to the 10 milliliter aliquot of solvent and the resulting mixture was added to the 500 milliliter flask. The mixture was then stirred for approximately 1 hour. To the 20 milliliters of solvent in the scintillation vial were added 2.25 grams of decyltrimethoxysilane and 0.06 gram of aminopropyltriethoxysilane. This mixture was added to the 500 milliliter flask containing the $SiO_2$ after the 1 hour of the above pretreatment was completed. A heating mantle was attached, and the mixture was heated to reflux with stirring and under the inert atmosphere. Heat was applied for approximately 5 hours and then was turned off and the mixture was allowed to cool down to room temperature, about 25° C. The mixture then was transferred to a tear shaped flask and the flask attached to a rotovapor evaporator and the solvent stripped off with heat and vacuum. The flask was transferred to a vacuum oven and the drying completed over night, about 18 hours throughout under full vacuum and moderate temperature of 40° C. The resulting decylsilane/aminopropylsilane coated silica was crushed with a mortar and pestle, and had a primary particle size of 30 nanometers as measured by BET and an aggregate size of about 300 nanometers as measured by Browning Motion.

EXAMPLE II

Preparation of Coated Silica

Thirty grams of an untreated hydrophilic $SiO_2$ silica powder core with a primary particle size of 40 nanometers and an aggregate size of about 300 nanometers were placed in a Buechi 2 liter autoclave reactor, and the reactor was sealed. An inert gas, argon, was then purged for 30 minutes through the reactor to remove atmospheric gases. The reactor was then evacuated of atmospheric gases using a vacuum pump and warmed to 28° C. The vacuum valve was then closed and an ampoule of triethylamine was connected to the reactor such that the vapor space of the ampoule and the upper portion of the reactor are connected, thereby allowing the vapor phase transport of triethylamine to the bed of silica for 15 minutes. The valve from the ampoule to the reactor was then closed and the valve to the vacuum reopened to remove the triethylamine that was not physisorbed to the surface of silica. The reactor was then cooled to 0° C. with the aide of a Laude circulating bath connected to the reactor jacket. After achieving a temperature of 0° C., 570 grams of carbon dioxide (bone-dry grade obtained from Praxair) were then added to the chilled reactor with the assistance of an ISCO Model 260D motorized syringe pump. Agitation of the reactor was then initiated at 10 rpm. 4.5 Grams of decyltrimethoxysilane from Shin-Etsu Silicones, and 0.12 gram of aminopropyltrimethoxysilane from PCR Research Chemicals catalog were then dissolved in separate variable volume pressure cells using carbon dioxide as the solvent. The pressure in the cell was 100 bar which was sufficient to generate a homogeneous solution of the two silanes in carbon dioxide. The decyltrimethoxysilane solution was then injected into the Buechi 2 liter reactor. This injection procedure was then repeated with the 0.12 gram of aminopropyltriethoxysilane. Subsequent to the injection of this second reagent, the temperature of the reactor was maintained at 0° C. and agitated at 100 rpm for 30 minutes; the agitation was then stopped, and the carbon dioxide was vented off from the upper portion of the reactor, the vapor space. Subsequent to the aforementioned depressurization, the reactor temperature was increased to 28 to 30° C. After equilibration at this temperature, the resulting decylsilane/aminopropylsilane treated or coated silica product was removed for overnight vacuum treatment (about 18 hours, 150° C. for three hours) and then spectroscopically characterized via infrared spectroscopy.

EXAMPLE III

A toner resin was prepared by a polycondensation reaction of bisphenol A and fumaric acid to form a linear polyester referred to as Resapol HT.

A second polyester was prepared by selecting Resapol HT and adding to it in an extruder a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, and more specifically, the polyester of the '494 patent, the disclosures of each of these patents being totally incorporated herein by reference.

EXAMPLE IV

75 Parts by weight of the resin Resapol HT from Example III, 14 parts by weight of the 30 weight percent gel polyester from Example III, and, 11.0 parts by weight of Sun Blue Flush, which is a mixture of 30 weight percent P.B.15:3 copper phthalocyanine and 70 weight percent Resapol HT prepared at Sun Chemicals by flushing to obtain a high quality pigment dispersion, were blended together and extruded in a ZSK-40 extruder. The extruded blend was then jetted and classified to form a cyan toner (with 93 weight percent of resin and about 7 weight percent of P.B.15:3) with a toner particle size of about 6.5 microns as measured by a Layson Cell. The final cyan toner had a gel concentration of 5 weight percent.

COMPARATIVE EXAMPLE V

A thirty gram sample of toner from Example IV was added to a 9 ounce jar with 150 grams of stainless steel beads. To this was added 0.6 weight percent TS530 (15 nanometers of primary particle size fumed silica coated with hexamethyldisilazane from Cab-O-Sil Division of Cabot Corp.), 0.9 weight percent TD3103 (15 nanometers of primary particle size titanium dioxide coated with decylsilane generated from decyltrimethoxysilane from Tayca Corp.), and 0.3 weight percent zinc stearate L from Synthetic Products Company. After mixing on a roll mill for 30 minutes, the steel beads were removed from the jar.

A developer was prepared by mixing 4 parts of the blended toner with 100 parts of a carrier of a Hoeganaes steel core coated with 80 weight percent of polymethylmethacrylate and 20 weight percent of a conductive carbon black. Testing of this developer in an imaging fixture similar to the Xerox 5090 resulted in poor image quality primarily because of a loss in developability of the toner caused by, for example, the small size 15 nanometer TS530 silica, small size 15 nanometers of the TD3103 titanium dioxide, and/or coatings on the silica.

COMPARATIVE EXAMPLE VI

A toner blend was prepared as in Example V except 4.2 weight percent RX515H (40 nanometers of primary particle size and about 300 nanometers of aggregate size fumed silica coated with a mixture of hexamethyldisilazane and aminopropyltriethoxysilane, which coated silica was obtained from Nippon Aerosil Corp.), 2.5 weight percent of MT5103 (30 nanometers of primary particle size titanium dioxide coated with decylsilane obtained from Tayca Corp.), and 0.3 weight percent zinc stearate L from Synthetic Products Company, were blended onto the toner surface. After mixing on a roll mill for 30 minutes, the steel beads were removed from the jar. A developer was prepared by mixing 4 parts of the above blended toner with 100 parts of a carrier of Hoeganaes steel core coated with polymethylmethacrylate and 20 weight percent of a conductive carbon black. A 90 minute paint shake time track was completed for this developer with a resulting toner tribo at the end of 90 minutes equal to −16.5 microcoulombs/gram. During the 90 minute time track, tribo was unstable and decreased with increasing time. An admix evolution was accomplished at the end of the 90 minutes resulting in a unimodal charge distribution at 15 seconds, but becoming bimodal by 1 to 2 minutes of additional paint shaking. This bimodal distribution consisted of incumbent toner that had moved toward zero charge, and incoming toner that charged against the incumbent toner to a higher charge level than incumbent toner. Upon breadboard machine, similar to the Xerox Corporation 5090 testing with freshly blended toner from above, low quality images resulted after about 2,000 copies were made. The poor images were caused primarily by wrong sign toner, the bimodal charge distribution that occured in the machine developer housing, which was simulated by the paint shake time track/admix. The low q/d charge toner with a q/d near zero resulted in dirt and background on the image and the high q/d charge toner with a q/d (fc/u femtocoulombs per micron) of about 0.7 or greater adhered to the developer wires resulting in poor development as evidenced by low image density in parts of the image.

EXAMPLE VII

A toner blend was generated as in Example VI except the RX515H was replaced with 3.2 weight percent of a 30 nanometer primary particle size and about 300 nanometer aggregate size fumed silica core (L90 core) coated with a feed mixture of 15 weight percent decyltrimethoxysilane and 0.4 weight percent aminopropyltriethoxysilane, which coated silica was obtained from Cab-O-Sil division of Cabot Corp.

A developer was prepared by mixing 4 parts of the above blended toner with 100 parts of a carrier of a Hoeganaes steel core coated with 80 weight percent polymethylmethacrylate and 20 weight percent of a Vulcan conductive carbon black. A 90 minute paint shake time track was completed for this developer with a resulting toner tribo at the end of 90 minutes equal to −19.7 microcoulombs/gram. During the 90 minute time track, toner tribo was stable and did not decrease with increasing time. Admix was accomplished at the end of the 90 minutes, resulting in a unimodal charge distribution at 15 seconds. Unlike the developer in Example VI, the charge distribution of the incumbent and incoming toner in this Example remained unimodal with no low charge (<0.2 fc/u) or wrong sign toner with a q/d (femtocoulombs/micron, q being the toner charge and d being toner diameter) near zero or less than zero throughout the additional 2 minutes of total paint shaking. This developer enabled excellent copy quality images having excellent image density and low acceptable background.

EXAMPLE VIII

A toner blend was prepared as in Example VI except the RX515H was replaced with 3.2 weight percent of a 30 nanometer primary particle size and about 300 nanometer aggregate size fumed silica core (L90 core) coated with a feed of 15 weight percent decyltrimethoxysilane and 0.5 weight percent aminopropyltriethoxysilane, which coated silica containing decylsilane and aminopropylsilane was obtained from Cab-O-Sil division of Cabot Corp. A developer was prepared by mixing 4 parts of the above blended toner with 100 parts of a carrier of Hoeganaes steel core coated with 80 weight percent polymethylmethacrylate and 20 weight percent of a conductive carbon black. A 90 minute paint shake time track was completed for this developer with a resulting toner tribo at the end of 90 minutes equal to −18.9 microcoulombs/gram. During the 90 minute time track, toner tribo was stable and did not decrease with increasing time. Admix was accomplished at the end of the 90 minutes, resulting in a unimodal charge distribution at 15 seconds. Unlike the developer in Example VI, the charge distribution of the incumbent and incoming toner in this Example remained unimodal with no low charge (<0.2 fc/u) or wrong sign positively charged toner having a q/d near zero or less than zero throughout the 2 minutes of additional paint shaking. This developer enabled excellent copy quality images having excellent image density and low/acceptable background in a Xerox Corporation 5090 breadboard test fixture.

Other modifications of the present invention may occur to one of ordinary skill in the art subsequent to a review of the present application, and these modifications, including equivalents thereof, are intended to be included within the scope of the present invention.

What is claimed is:

1. A negatively charged toner comprised of resin, colorant and a coated silica, and wherein the silica has a primary particle size of about 25 nanometers to about 55 nanometers and an aggregate size of about 225 nanometers to about 400 nanometers; and the silica has a coating comprised of a mixture of an alkylsilane and an aminoalkylsilane, such that the coated silica is comprised of from about 10 weight percent to about 25 weight percent alkylsilane and from about 0.1 weight percent to about 5 weight percent aminoalkylsilane.

2. The negatively charged toner in accordance with claim 1 wherein the toner further contains surface additives of metal oxides, metal salts, metal salts of fatty acids, or mixtures thereof.

3. The negatively charged toner in accordance with claim 1 wherein the toner further contains surface additives of titania, metal salts of fatty acids, or mixtures thereof.

4. The negatively charged toner in accordance with claim 3 wherein the titania is coated with an alkylsilane.

5. The negatively charged toner in accordance with claim 4 wherein said alkyl is butyl, hexyl, octyl, decyl, dodecyl, or stearyl.

6. The negatively charged toner in accordance with claim 3 wherein said titania is coated with decylsilane.

7. The negatively charged toner in accordance with claim 1 wherein the resin is polyester.

8. The negatively charged toner in accordance with claim 1 wherein the resin is a polyester formed by condensation of propoxylated bisphenol A and a dicarboxylic acid.

9. The negatively charged toner in accordance with claim 1 wherein the resin is comprised of a mixture of a polyester formed by condensation of propoxylated bisphenol A and fumaric acid, and a gelled polyester formed by condensation of propoxylated bisphenol A and fumaric acid.

10. The negatively charged toner in accordance with claim 1 wherein the colorant is carbon black, cyan, magenta, yellow, red, orange, green, violet , or mixtures thereof.

11. The negatively charged toner in accordance with claim 1 wherein the silica is coated with a mixture of a decylsilane and aminopropylsilane.

12. The negatively charged toner in accordance with claim 1 wherein alkyl contains from about 1 to about 25 carbon atoms.

13. The negatively charged toner in accordance with claim 1 wherein said alkyl is butyl, hexyl, octyl, decyl, dodecyl, or stearyl.

14. The negatively charged toner in accordance with claim 1 wherein the silica is coated with an input feed mixture of about 10 weight percent to about 25 weight percent alkyltrialkoxysilane and about 0.10 weight percent to about 5.0 weight percent aminoalkyltrialkoxysilane.

15. The negatively charged toner in accordance with claim 1 wherein alkyl contains from 1 to about 25 carbon atoms.

16. The negatively charged toner in accordance with claim 1 wherein the silica is coated with an input feed mixture of about 10 to about 15 weight percent decyltrialkoxysilane and about 0.15 weight percent to about 0.50 weight percent aminoalkyltrialkoxysilane.

17. The negatively charged toner in accordance with claim 1 wherein the colorant is a pigment, or a dye, and said alkylsilane is an alkylalkoxysilane.

18. The negatively charged toner in accordance with claim 1 wherein said coated silica is present in an amount of from about 1 weight percent to about 10 weight percent.

19. The negatively charged toner in accordance with claim 1 wherein said coated silica is present in an amount of from about 4 weight percent to about 10 weight percent.

20. A developer comprised of the negatively charged toner of claim 1 and a carrier.

21. A toner consisting essentially of resin, colorant and a silica, coated with a polymer of (i) alkylsilane, and (ii) an aminoalkylsilane, wherein the silica has a primary particle size of from about 25 nanometers to about 55 nanometers and an aggregate size of from about 225 nanometers to about 400 nanometers.

22. The toner in accordance with claim 21 wherein said coating is represented by a formula

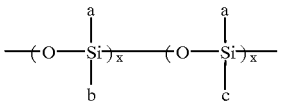

wherein:

a is selected from the group consisting of:

repeating segments of the formula by which a cross-linked structure is created within the coating;

repeating segments of the formula and hydroxy groups;

repeating segments of the formula and alkoxy groups; or repeating segments of the formula, hydroxy groups and alkoxy groups; and b is alkyl;

c is aminoalkyl; and x represents the number of segments.

23. The toner of claim 21 having a negative charge.

24. The toner of claim 21 having a positive charge.

25. A negatively charged toner comprised of resin, colorant and a coated silica, and wherein said silica has an aggregate size of about 150 nanometers to about 400 nanometers, and wherein said silica has a primary particle size of about 25 nanometers to about 55 nanometers, and wherein said silica is coated with a mixture of an alkylsilane and an aminoalkylsilane.

26. The negatively charged toner in accordance with claim 25 wherein the silica has an aggregate size of about 300 nanometers to about 375 nanometers.

27. The negatively charged toner of claim 25, wherein the toner has primary particle size of from about 30 nanometers to about 40 nanometers.

28. The negatively charged toner of claim 25 wherein the toner has a primary particle size of from about 30 nanometers to about 40 nanometers and an aggregate size of from about 200 nanometers to about 275 nanometers.

29. A process for the preparation of a negatively charged toner comprising admixing resin, colorant, and a coated silica, wherein said silica has a primary particle size of about 25 nanometers to about 55 nanometers and an aggregate size of about 225 nanometers to about 400 nanometers, and said coating is comprised of a mixture of an alkylsilane and an aminoalkylsilane.

30. The process in accordance with claim 29 wherein said mixture is generated from an alkyloxysilane and an aminoalkylalkoxysilane.

* * * * *